US006668718B2

(12) United States Patent
van den Brink et al.

(10) Patent No.: US 6,668,718 B2
(45) Date of Patent: Dec. 30, 2003

(54) PRINTING MACHINE WITH EXCHANGEABLE INK APPLICATION MEANS

(75) Inventors: Lambert Dirk van den Brink, Cuijk (NL); Henricus Andreas Jozef Hoendervangers, Ommel (NL)

(73) Assignee: Multi Print Systems B.V., Cuijk (NL)

( * ) Notice: Subject to any disclaimer, the term of this patent is extended or adjusted under 35 U.S.C. 154(b) by 0 days.

(21) Appl. No.: 10/093,410

(22) Filed: Mar. 11, 2002

(65) Prior Publication Data

US 2002/0088356 A1 Jul. 11, 2002

Related U.S. Application Data

(63) Continuation of application No. 09/038,046, filed on Mar. 11, 1998, now Pat. No. 6,382,092.

(30) Foreign Application Priority Data

Mar. 13, 1997 (NL) ..... 1005525

(51) Int. Cl.[7] ..... B41F 5/00

(52) U.S. Cl. ..... 101/216; 101/177; 101/181; 101/115; 101/219; 101/485; 101/DIG. 49

(58) Field of Search ..... 101/219, 479, 101/115, 116, 177, 181, 216, 228, 350.1, 483, 485, 328, 368, 375, DIG. 43, DIG. 49

(56) References Cited

U.S. PATENT DOCUMENTS

| | | | | |
|---|---|---|---|---|
| 2,242,045 A | | 5/1941 | Scott et al. | |
| 2,270,273 A | | 1/1942 | Davidson | |
| 2,435,791 A | | 2/1948 | Luehrs | |
| 2,581,593 A | | 1/1952 | Luttenaue | |
| 2,690,121 A | | 9/1954 | Auerbracher et al. | |
| 2,716,942 A | | 9/1955 | Timson et al. | |
| 3,259,060 A | | 7/1966 | Martin | |
| 3,276,647 A | | 10/1966 | Lewis, Jr. et al. | |
| 3,618,516 A | | 11/1971 | Jurny | |
| 3,774,537 A | * | 11/1973 | Christoff | 101/219 |
| 3,793,952 A | | 2/1974 | Neumann et al. | |
| 3,889,596 A | | 6/1975 | Thomas et al. | |
| 4,046,070 A | * | 9/1977 | Halley | 101/216 |
| 4,103,615 A | | 8/1978 | Cruz et al. | |
| 4,411,194 A | * | 10/1983 | Davidson, Jr. | 101/216 |
| 4,509,424 A | * | 4/1985 | Germann | 101/177 |
| 5,385,091 A | | 1/1995 | Cuir et al. | |
| 5,392,709 A | | 2/1995 | Seyffert et al. | |
| 5,400,709 A | * | 3/1995 | Drilling et al. | 101/115 |
| 5,477,783 A | | 12/1995 | Hashimura | |
| 5,505,128 A | | 4/1996 | Van Den Brink | |
| 5,546,860 A | | 8/1996 | Riis | |
| 5,549,044 A | | 8/1996 | Achelpohl | |
| 5,630,363 A | * | 5/1997 | Davis et al. | 101/181 |
| 5,813,345 A | * | 9/1998 | Fuller et al. | 101/488 |
| 6,095,040 A | * | 8/2000 | Ashikagaya et al. | 101/116 |
| 6,386,100 B1 | * | 5/2002 | Gaffney et al. | 101/216 |

* cited by examiner

*Primary Examiner*—Eugene H. Eickholt
(74) *Attorney, Agent, or Firm*—Birch, Stewart, Kolasch & Birch, LLP

(57) ABSTRACT

A printing machine for printing a substrate web, which printing machine comprises at least one printing module, such a printing module being provided with an impression roller and ink application means, the ink application means comprising a cylindrical element, which cylindrical element extends parallel to the impression roller and abuts against the impression roller at a contact line with interposition of the substrate web, the cylindrical element being arranged to apply a desirable ink printing pattern to the substrate web, wherein a relevant printing module is provided with a circumferential bearing which engages an outer surface of a relevant cylindrical element, which can be brought into a locking position and into an exchange condition, the circumferential bearing being arranged to receive cylindrical elements intended for different printing techniques, such as silk-screen printing, flexographic printing, letterpress printing, intaglio printing, offset printing and the like.

10 Claims, 10 Drawing Sheets

PRINTING MACHINE WITH EXCHANGEABLE INK APPLICATION MEANS

This application is a continuation of co-pending application Ser. No. 09/038,046, filed on Mar. 11, 1998 U.S. Pat. No. 6,382,092, the entire contents of which are hereby incorporates by reference and for which priority is claimed under 35 U.S.C. §120; and this application claims priority of Application No. 1005525 filed in The Netherlands on Mar. 13, 1997 under 35 U.S.C. §119.

The invention relates to a printing machine for printing a substrate web, which printing machine comprises at least one printing module, such a printing module being provided with an impression roller and ink application means, the ink application means comprising a cylindrical element, which cylindrical element extends parallel to the impression roller and abuts against the impression roller at a contact line with interposition of the substrate web, the cylindrical element being arranged to apply a desirable ink printing pattern to the substrate web.

Such an apparatus is known from practice. The known apparatus has the drawback that it is very time-consuming to change printing techniques in a printing module. When changing from, e.g., flexographic printing to silk-screen printing, the driving elements and the bearing elements of the ink application means must be exchanged and reset. Moreover, it is often necessary to exchange the impression roller. In general, for flexographic printing and letterpress printing another impression roller is actually used than for silk-screen printing. Not only is it time-consuming to exchange the impression roller, but, moreover, the substrate web must be removed for that purpose, which leads to a considerable amount of waste. The operational costs of the known apparatus are therefore high. Furthermore, the ink application means of different types require bearing and driving means of their own, which, upon purchase of the printing machine, lead to a very high investment. The purchasing costs of the apparatus known from practice are therefore very high as well.

The object of the invention is to provide a printing machine without the above-described disadvantages.

To that end, a printing machine of the type described in the opening paragraph is characterized according to the invention in that a relevant printing module is provided with a circumferential bearing which engages an outer surface of a relevant cylindrical element, the or each circumferential bearing in an operating condition of the printing module being in a locking position in which the cylindrical element is pressed towards and against the impression roller, which circumferential bearing can be brought into a condition of exchange such that the cylindrical element can be taken from the printing module, the circumferential bearing being arranged to receive cylindrical elements intended for different printing techniques, such as silk-screen printing, flexographic printing, letterpress printing, intaglio printing, offset printing and the like.

Such a circumferential bearing is very stable and, moreover, provides sufficient space during silk-screen printing to receive a squeegee in the screen. Also, by using the same circumferential bearing for all types of printing techniques the same driving motors and driving control can be used for all types of printing techniques, which is very favorable from considerations of costs. During use of the printing machine according to the invention too, a considerable saving of the operational costs is effected because the change of printing technique is much less time-consuming.

In essence, only the cylindrical element needs to be exchanged, which, as a result of the circumferential bearing, can be done in no time. The driving means further remain untouched. The specific ink application rollers, squeegees and the like, belonging to a specific printing technique, for transferring the ink to the surface of the cylindrical element can be readily exchanged and are drivably connected to the driving means of the cylindrical element. The setting times can be considerably shortened by this exchange method.

As stated above, it is a frequently occurring drawback of the printing machines known from practice that when changing printing techniques in a specific module, if this is possible at all, the impression roller must be frequently exchanged as well. Apart from the expenditure of time, the exchange of the impression roller also produces a considerable amount of waste.

According to a further elaboration of the invention, the ink application means are bearing-mounted in a relevant printing module in a manner such that they are removable and positionable without it being necessary to remove the substrate web from the relevant printing module, the impression roller being provided with a flexible surface and being bearing-mounted for free rotation.

In the market, the prejudice existed that a hard impression roller was a requisite for flexographic printing and letterpress printing. Supposedly, the impression roller had to be hard in order to obtain the required printing sharpness and, moreover, to obtain a stable drive of the substrate web. In these printing techniques, the impression roller was actually also used as a substrate web driving roller. For a driving impression roller with a flexible surface the radius of the driving roller was believed to vary as a result of the tension in the substrate web. Supposedly, such a variable radius led to local speed differences of the substrate web, which gave considerable conveying problems and a poor printing quality. By using a non-driven impression roller with a flexible surface according to the above-described further elaboration of the invention, the conveying problems no longer occur anyway. Moreover, by using a hard impression roller in the flexographic printing process or letterpress printing process, a very sharp printing quality can be obtained, in spite of the flexible surface of the impression roller. The printing quality may even be better than was hitherto conventional. For silk-screen printing a soft rubberized impression roller was already conventional in connection with the fact that the silk-screen printing screen which replaces the printing roller used during flexographic printing is rather hard and the roughnesses in the substrate must therefore be taken up by the impression roller. Because the same impression roller can be used in any circumstances, it is no longer necessary to exchange the impression roller, and the substrate web can remain in position during exchange of the ink application means, which leads to a considerable saving of time.

According to another elaboration of the invention, a relevant printing module can be provided with a substrate web conveyor roller which is drivable with a controllable drive, which substrate web conveyor roller serves to convey the substrate web, the ink application means of the or each printing module being provided with their own drive with an independently controllable speed, the printing machine being provided with a control for controlling the rotational speed of the or each substrate web conveyor roller and the driving speed of the drive of the ink application means of the or each printing module.

This independent control of the conveying speed of the substrate web and the rotational speed of the ink application means renders it possible to bring the ink application means of all printing modules, and in particular the printing roller for flexographic or letterpress printing or the silk-screen printing screen thereof, into a desired rotative position. The different printing modules can therefore be brought into and kept in a desired starting position, so that the printing process can be started with a minimum of printing losses. Moreover, the printing rollers or screens can be prevented from wandering relative to each other, that is to say, the rotative positions of these elements can be prevented from moving relative to each other. The drive of these means is in fact positively controllable. Thus, an excellent printing quality can be guaranteed with a minimum loss of substrate web and printing ink and a minimum of setting time.

Further elaborations of the invention are described in the subclaims and will be further explained hereinbelow, by means of a practical example, with reference to the accompanying drawings, in which:

Figure 1:
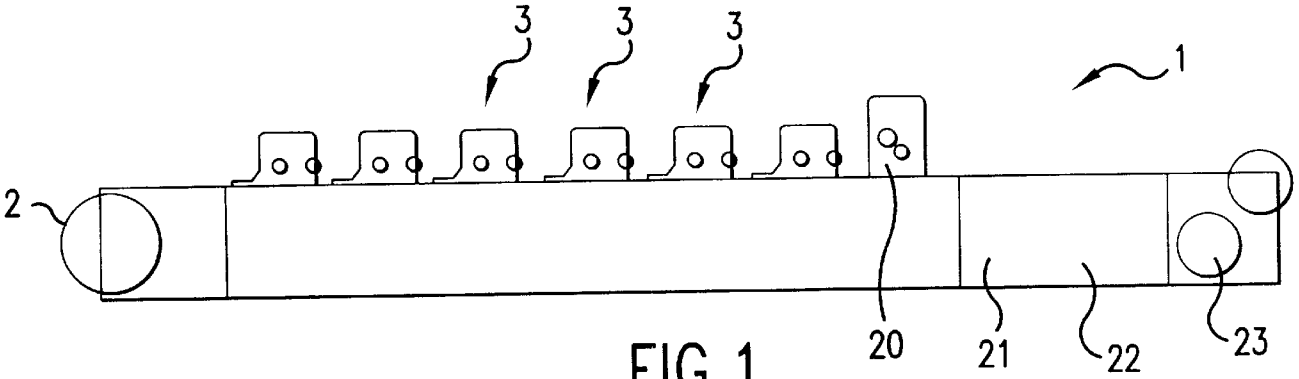
FIG. 1 is a diagrammatic side view of the apparatus according to the invention.

The printing machine 1 shown in FIG. 1 for printing a substrate web S comprises six printing modules 3. The printing modules 3 form part of a basic machine, which further comprises a wind-off roll 2 from which the substrate web S is unwound. The part where the wind-off roll 2 is located further comprises a web tension control function by means of which the tension of the substrate web S is determined. Located downstream of the printing modules 3 is, in the present case, a foil application module 20 by means of which, e.g., special foils, such as gold or silver foil, can be applied to the substrate web S. Provided downstream thereof are a laminating function 21 for applying a layer of transparent foil to the substrate web and a punching function 22 for punching out parts of the substrate web, such as, e.g., labels. At the end of the basic machine the remaining part of the substrate web S is wound on a roll 23.

Figure 4:
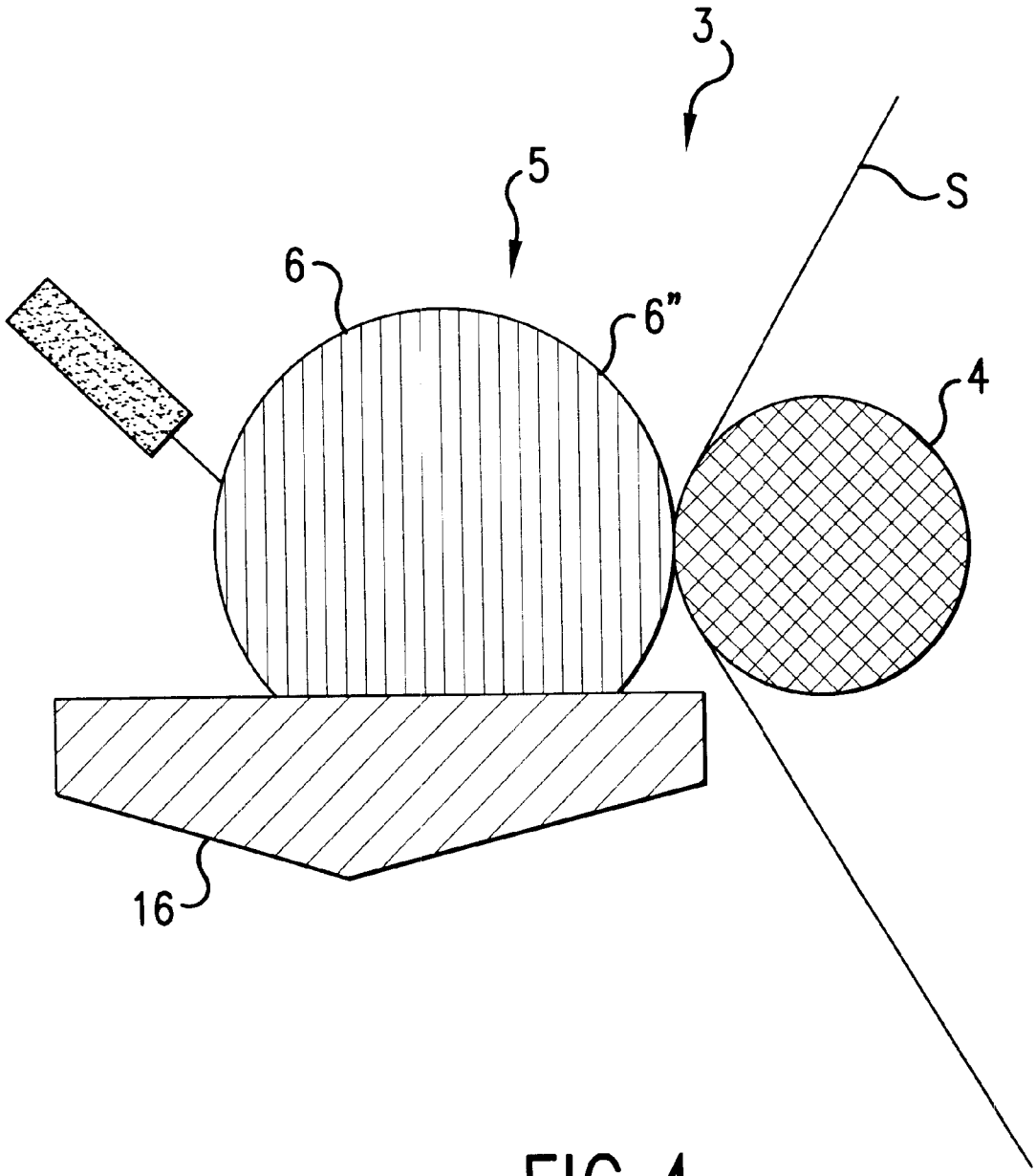
FIG. 4 shows the principle of intaglio printing.
Figure 5:
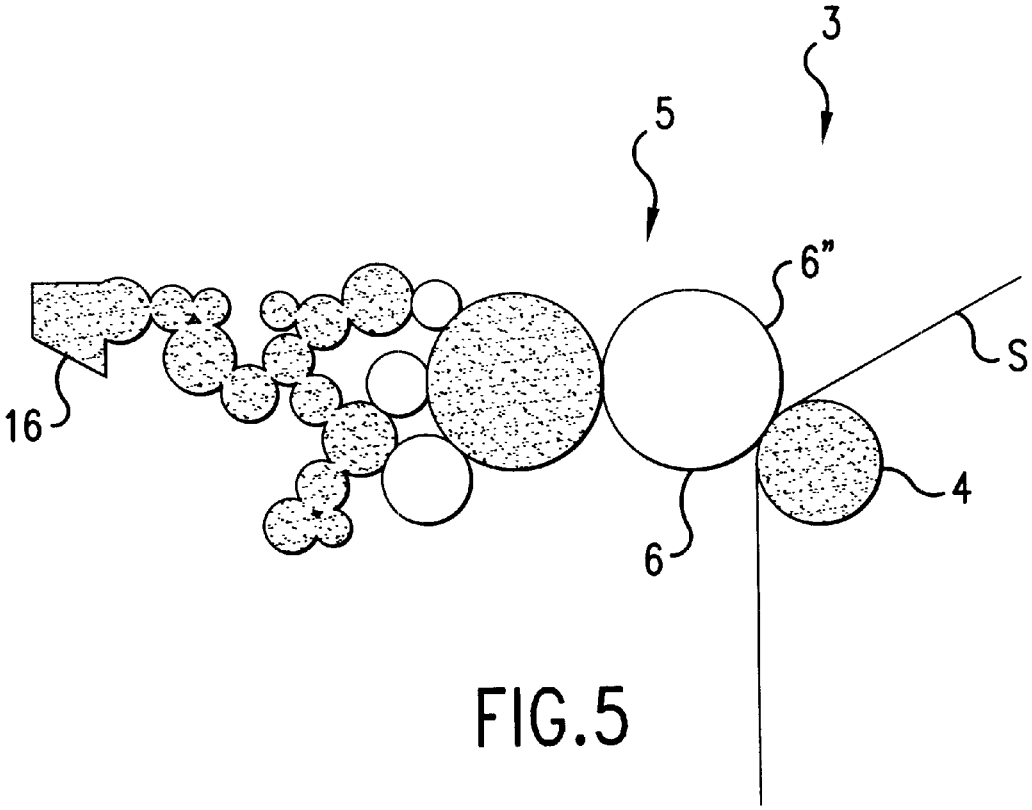
FIG. 5 shows the principle of offset printing.
Figure 6:
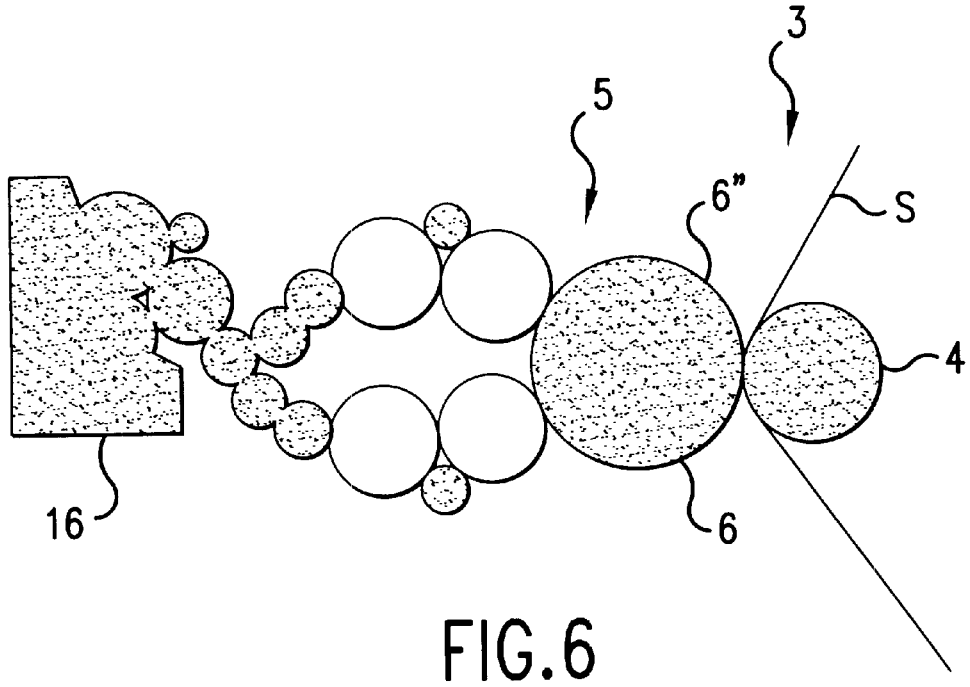
FIG. 6 shows the principle of letterpress printing.

As clearly shown in FIGS. 2–7, the printing modules 3 comprise an impression roller 4 and ink application means 5. The ink application means comprise a cylindrical element 6 which extends parallel to the impression roller 4, and which abuts against the impression roller 4 at a contact line L with interposition of the substrate web S. The cylindrical element 6 can be a screen 6' of a silk-screen printing module 3 (FIG. 3) or a printing roller 6" of a printing module 3 for flexographic printing (FIG. 2), a printing module for intaglio printing (FIG. 4), a printing module for offset printing (FIG. 5) or a printing module 3 for letterpress printing (FIG. 6). The cylindrical element 6 is arranged to apply a desired ink printing pattern to the substrate web S.

The printing modules 3 are of such design as to receive ink application means 5 of different types.

Figure 3:
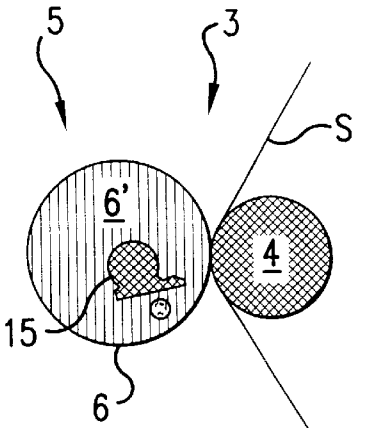
FIG. 3 shows the principle of silk-screen printing.

Thus, the ink application means 5 may be, e.g., of the silk-screen printing type. FIG. 3 shows the principle of the ink application means for silk-screen printing. In silk-screen printing, the cylindrical element 6 of the ink application means 5 is designed as a screen 6' which contains a squeegee 15. The interior of the screen 6' is connected to an ink feed. The screen 6' is of relatively stiff design for cooperation with the impression roller 4 provided with a flexible surface. Such a stiff screen 6' results in a very high printing sharpness.

Figure 2:
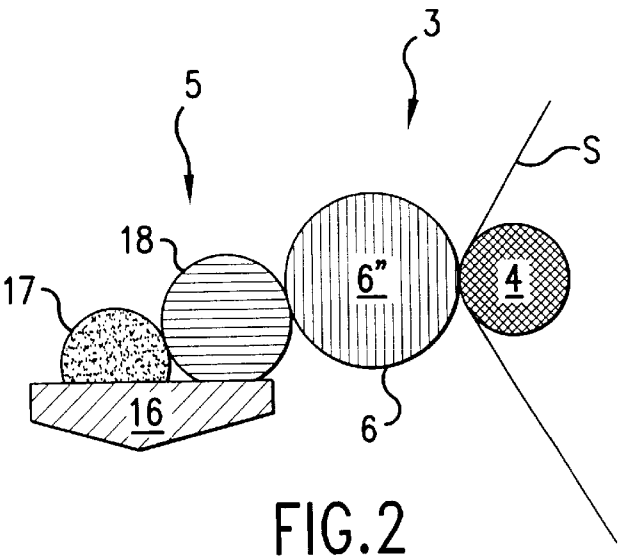
FIG. 2 shows the principle of flexographic printing.

Another possible embodiment of the ink application means 5 is shown in FIG. 2, in which the principle of flexographic printing is shown. Here the cylindrical element 6 of the ink application means 5 is designed as a printing roller 6" provided on the outer surface with a printing pattern. The ink application means 5 further comprise an ink fountain 16, a meter roller 17 and an anilox roller 18. The meter roller 17 and the anilox roller 18 are arranged to transfer and apply ink from the ink fountain 16 to the outer surface of the printing roller 6". In contrast with conventional flexographic printing, the printing roller 6" used with the flexographic printing ink application means according to the invention is relatively hard for cooperation with the impression roller 4 provided with a flexible surface. In conventional flexographic printing, a printing plate is attached to a printing cylinder by means of flexible tape which is adhesive on both sides. The impression roller is then made of steel. In the present case, the inventors have recognized that in flexographic printing it is also possible to use an impression roller with a flexible surface if at least use is made of a printing roller which is relatively hard. By relatively hard is meant herein: harder than the hitherto conventional flexographic printing rollers. This insight results in that the impression roller 4 never requires exchange.

Other possible embodiments for the ink application means 5 are shown in FIGS. 4–6, in which ink application means 5 of respectively the intaglio printing, the offset printing and the letterpress printing type are shown. For ink application means of these printing methods too, the cylindrical element 6 is designed as a printing roller 6" provided on the outer surface with a printing pattern. The ink application means 5 further comprise a large number of rollers 19, which are positioned in a manner known per se and are arranged to transfer and apply ink to the outer surface of the printing roller 6". Moreover, in this variant too, the printing roller 6" is relatively hard for cooperation with the impression roller 4 provided with a flexible surface.

The ink application means 5 and, accordingly, the cylindrical element 6 are bearing-mounted in an associated printing module 3 so as to be removable and positionable without it being necessary to remove the substrate web S from the relevant printing module 3. To that end, the impression roller 4 is provided with a flexible surface and is bearing-mounted for free rotation. The flexible surface of the impression roller 4 may be formed, e.g., by a layer of rubber or such flexible material. By removable is to be understood: removing from an active position in a manner such that other ink application means can be brought into the active position. FIG. 4 shows three printing modules 3 arranged in succession. In the middle printing module 3, the ink application means 6", 16, 17, 18 for flexographic printing are in the active position. In the right-hand printing module 3, the ink application means 6' for silk-screen printing are in the active position. In the right-hand printing module 3, it is also visible that the ink application means 5 for flexographic printing are in a non-active position.

Figure 7:
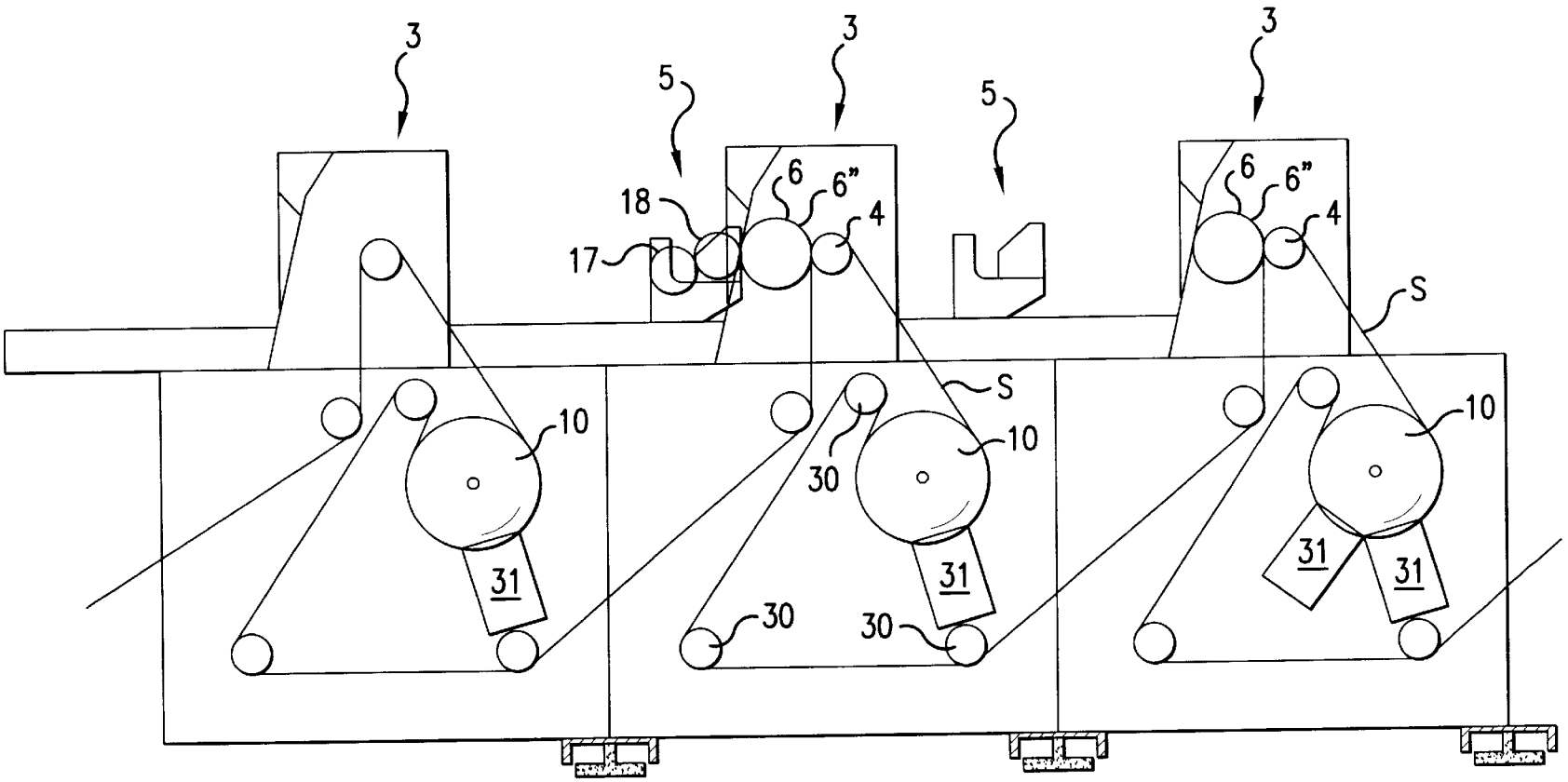
FIG. 7 is a diagrammatic cross-sectional view of a part of the printing machine according to the invention.
Figure 8:
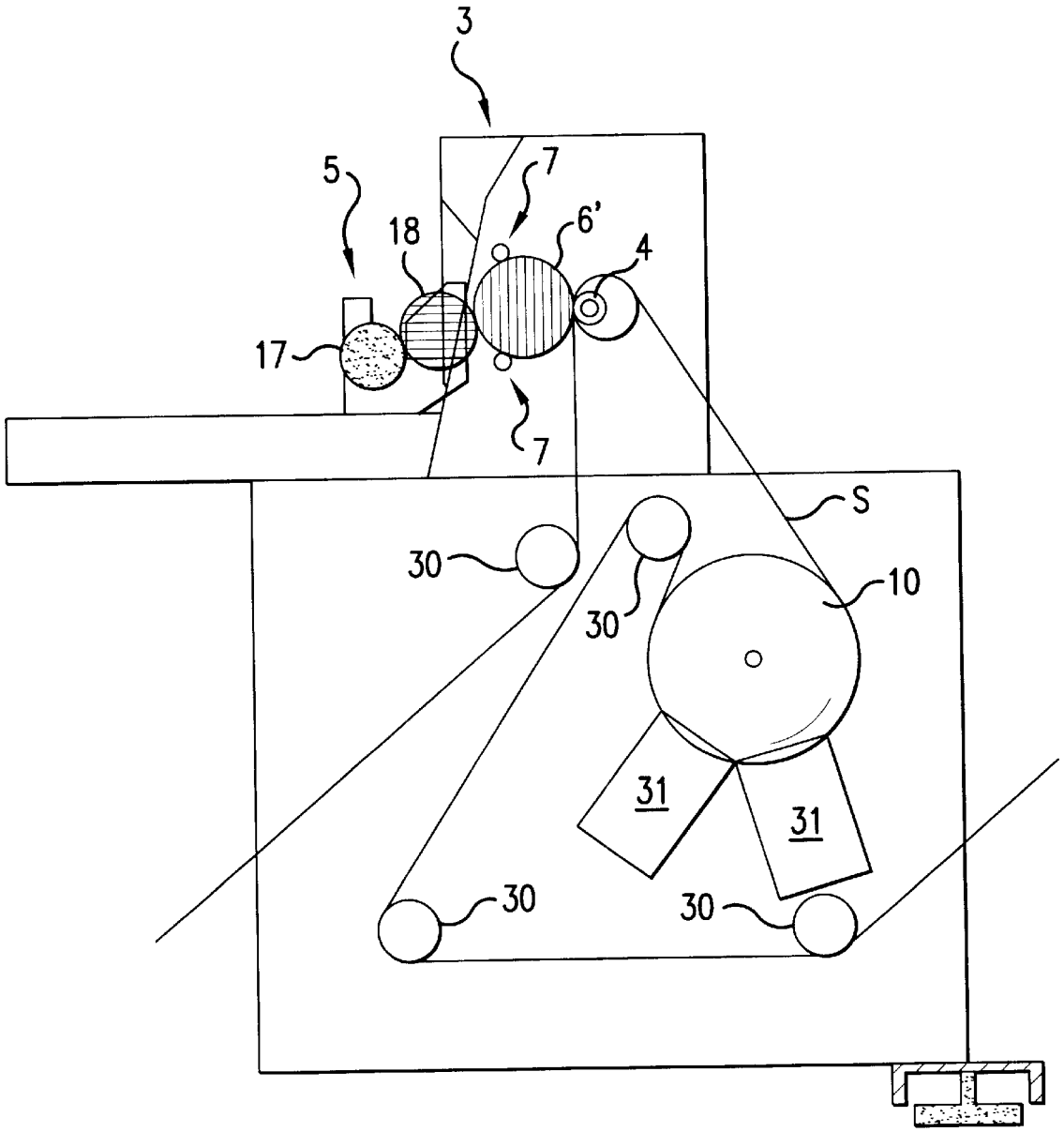
FIG. 8 is a diagrammatic cross-sectional view of a printing module for flexographic printing.
Figure 9:
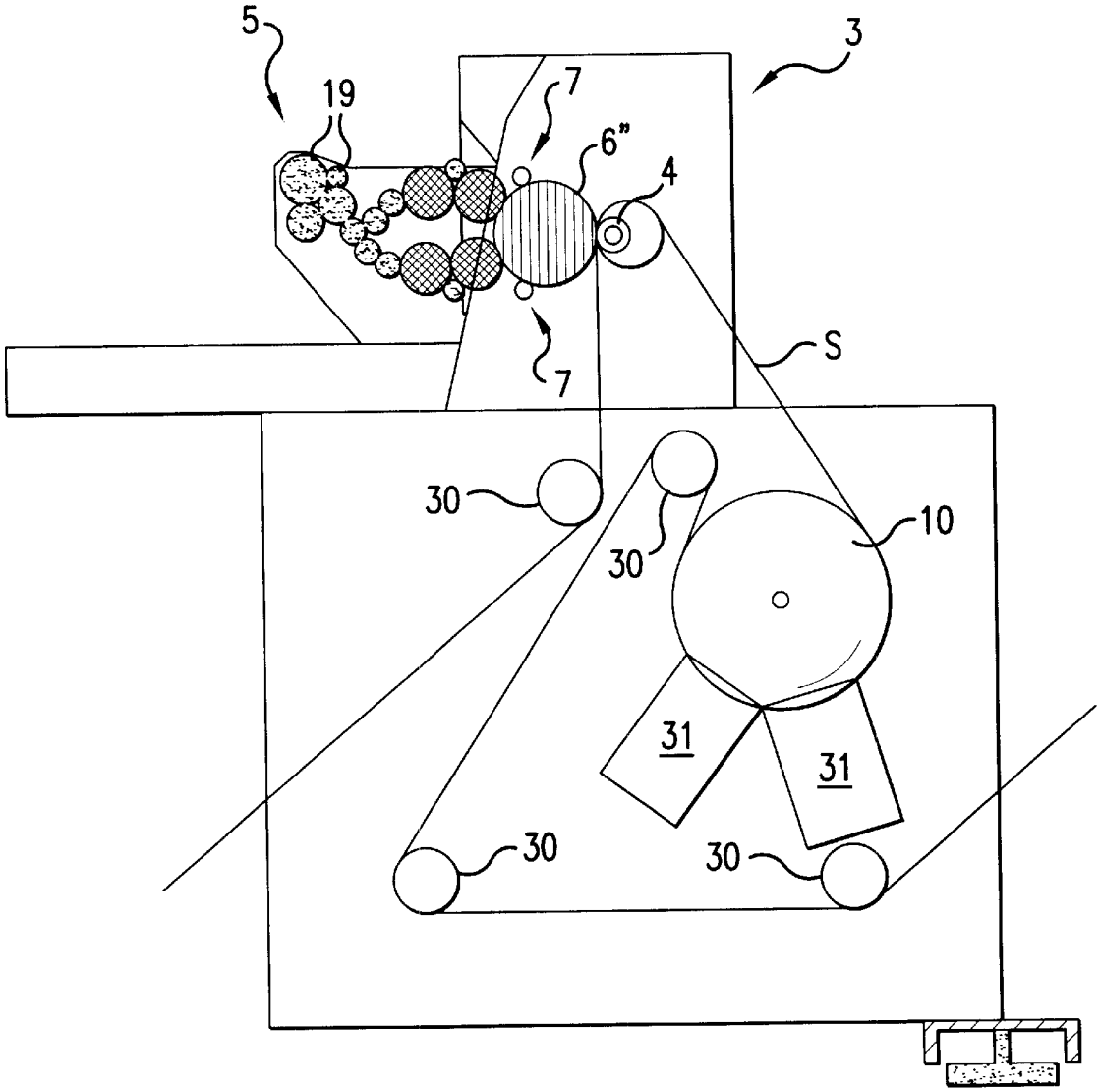
FIG. 9 is a diagrammatic cross-sectional view of a printing module for letterpress printing.

In order to enable a simple and rapid exchange of the cylindrical element 6, e.g., to replace a silk-screen printing roller 6' by a printing roller 6" for flexographic printing, letterpress printing, offset printing or intaglio printing, the cylindrical element 6 of the relevant printing module 3 is bearing-mounted in a circumferential bearing 7 which engages an outer surface P of the cylindrical element 6. The structure of this circumferential bearing is clearly shown in FIGS. 7–9. In an operating condition of the printing module 3, the circumferential bearing 7 is in a locking position in which the cylindrical element 6 is pressed towards and against the impression roller 4. The interplay of forces is shown in FIG. 7. The circumferential bearing 7 can be brought into an exchange condition such that the cylindrical element 6 can be taken from the printing module 3. To this end, the circumferential bearing 7 comprises circumferential bearing elements 8, 9, which are symmetrically arranged on both sides of a plane V, in which plane V the contact line L also extends. The forces F which the circumferential bearing elements 8, 9 exert on the cylindrical element 6 are symmetrical with respect to the above plane V and directed towards the contact line L where the cylindrical element 6 and the impression roller 4 contact each other. Since the circumferential bearing elements 8, 9 are movably arranged along a movement track A, the circumferential bearing 7 is suitable for receiving cylindrical elements 6 with different diameters. The circumferential bearing elements 8 only serve for the radial bearing of the cylindrical element 6, while the circumferential bearing elements 9 also effect an axial bearing of the cylindrical element.

Figure 10:
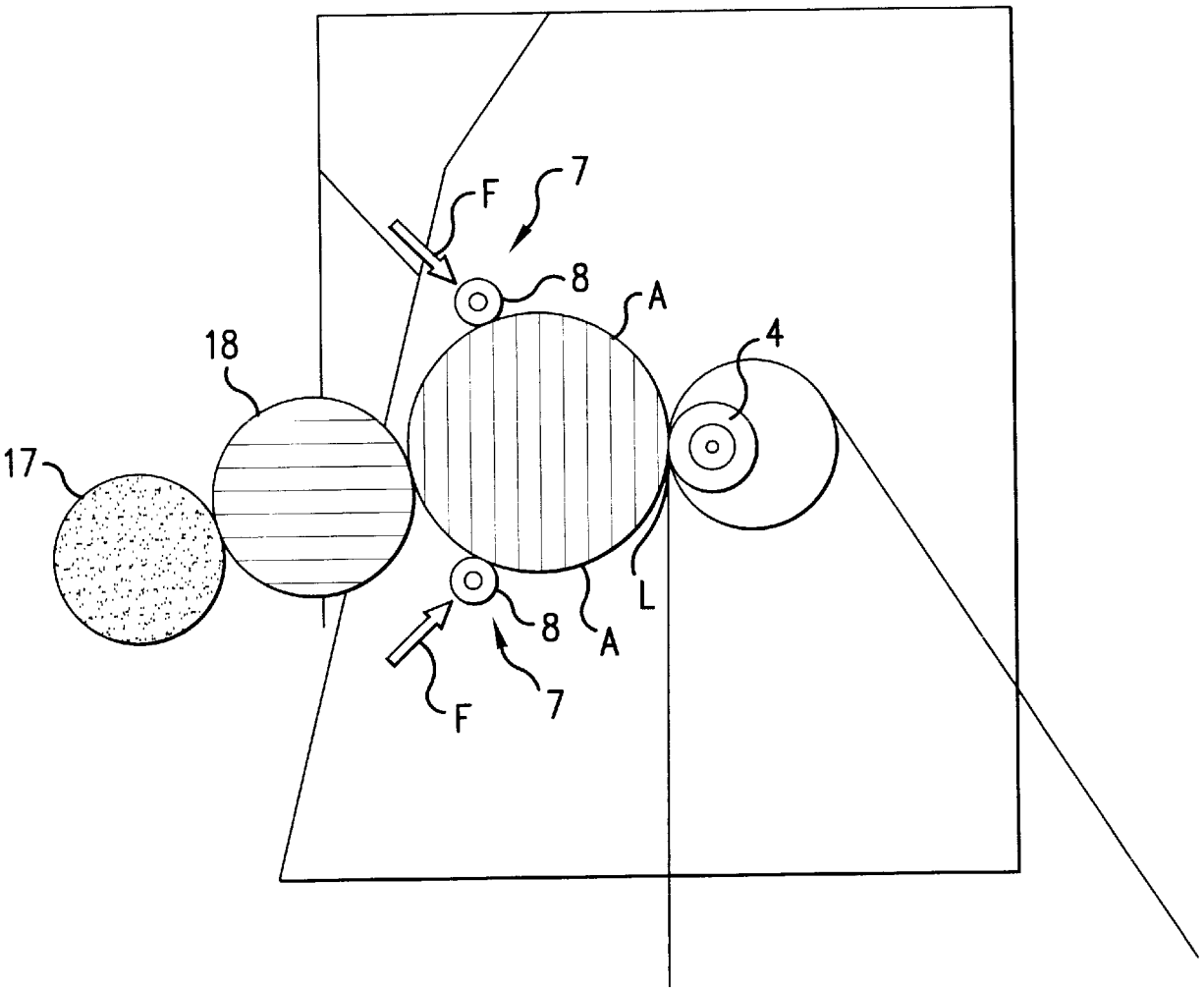
FIG. 10 is a diagrammatic cross-sectional view of the circumferential bearing and the associated interplay of forces.
Figure 11:
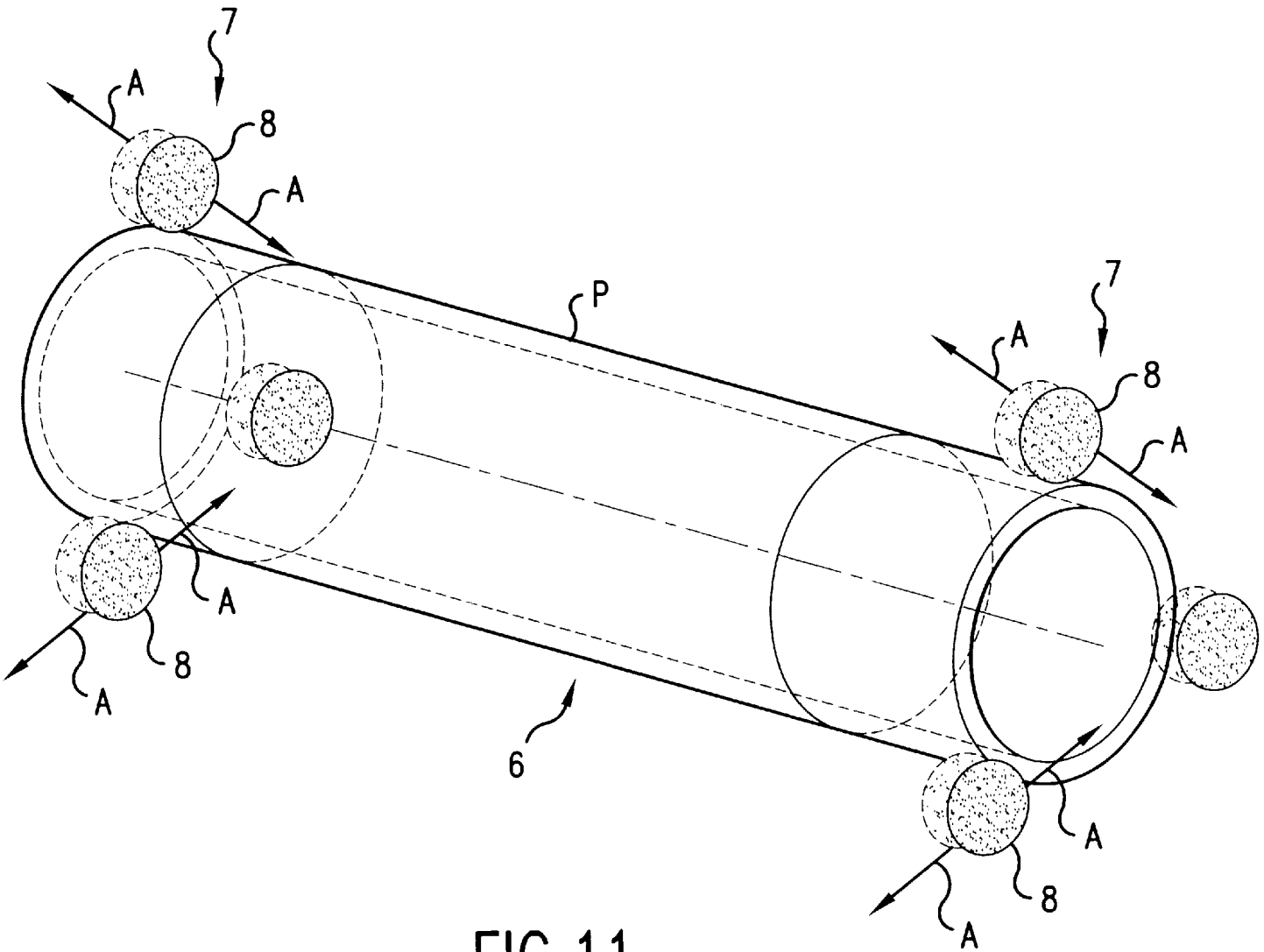
FIG. 11 is a diagrammatic perspective view of a printing roller or silk-screen roller with a circumferential bearing.
Figure 12:
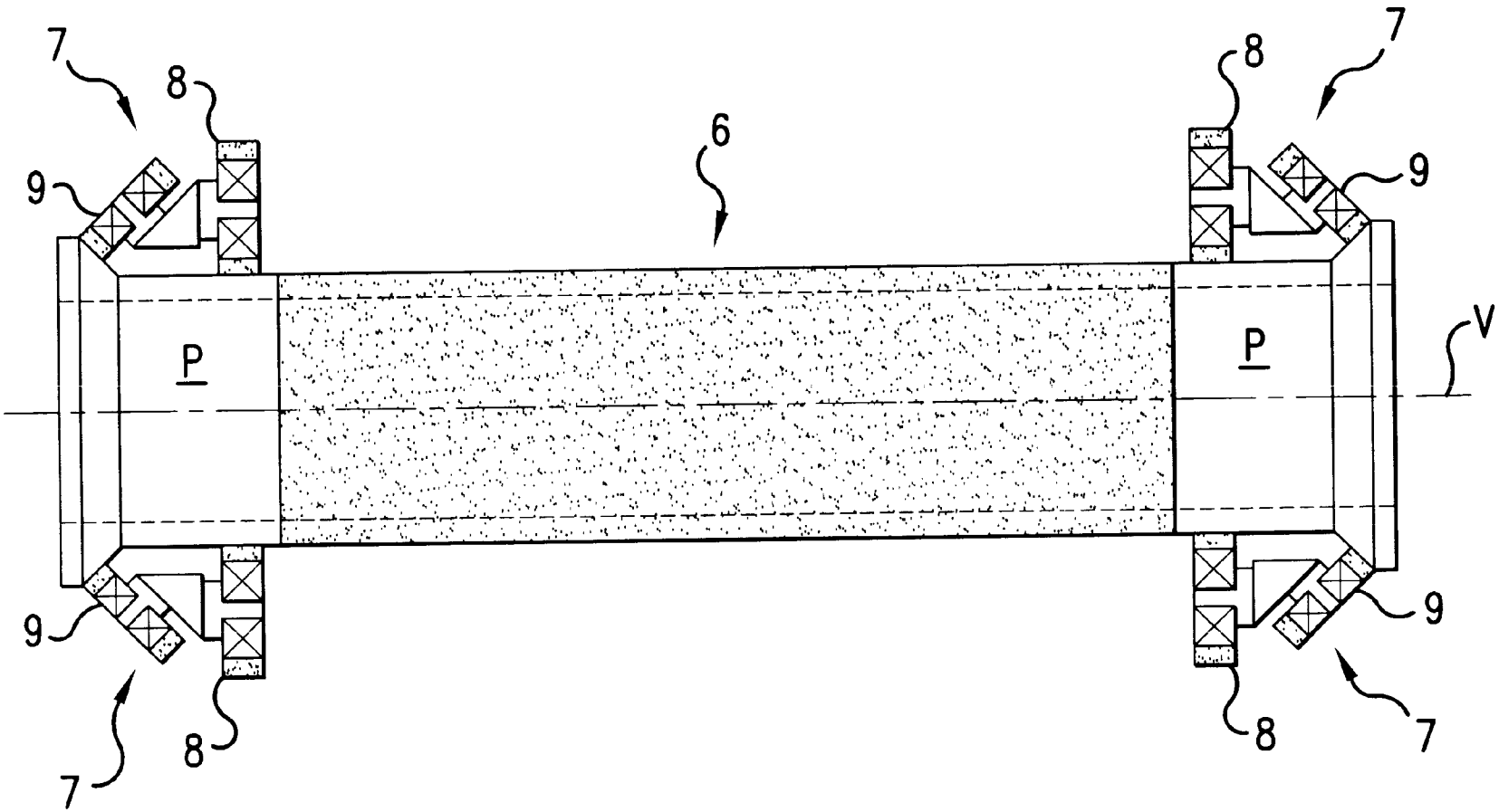
FIG. 12 is a diagrammatic front view of the printing roller or silk-screen roller shown in FIG. 11.
Figure 13:
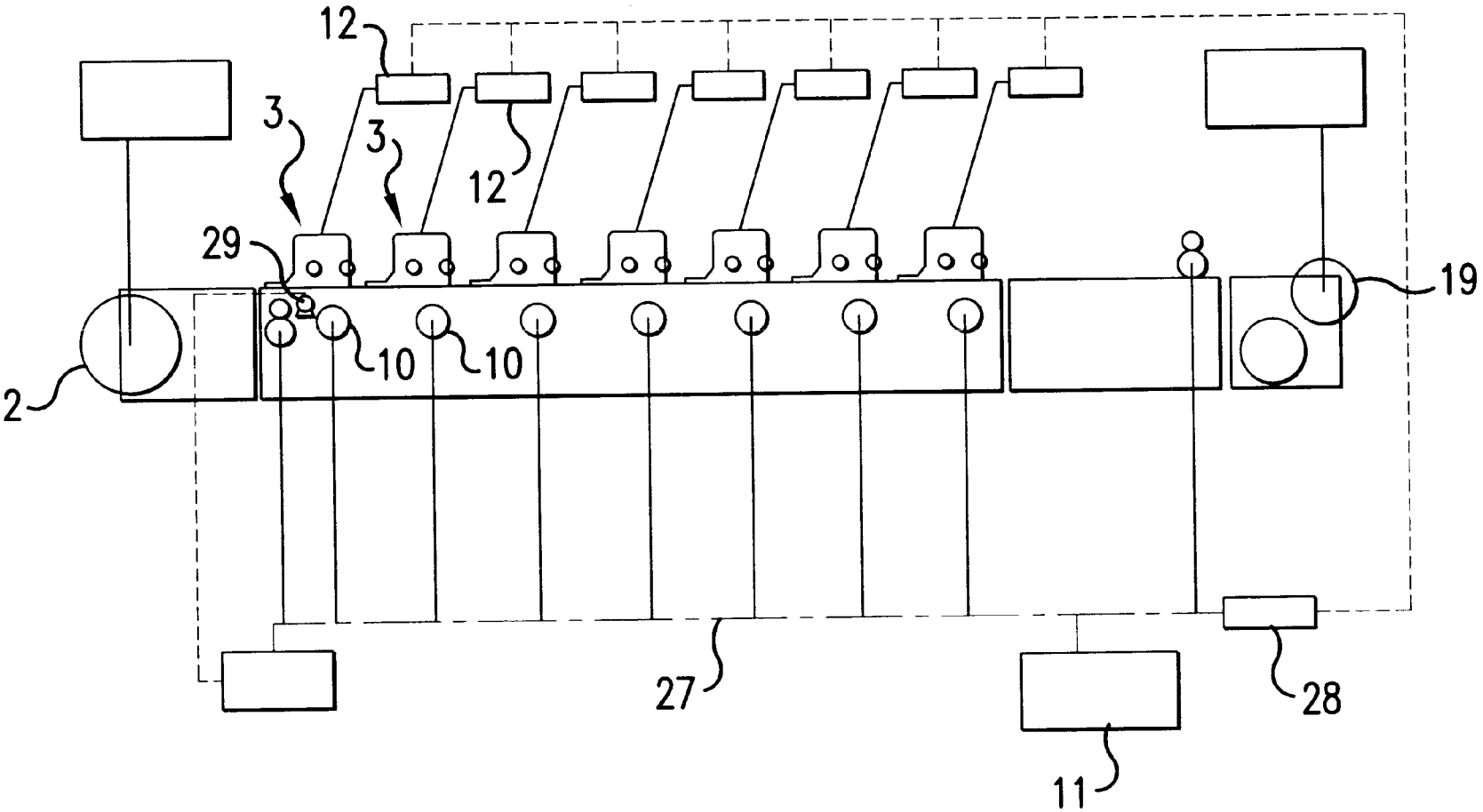
FIG. 13 is a diagrammatic control diagram of the different drives of the printing machine.

FIGS. 4, 5 and 10 show that each printing module 3 comprises a substrate web conveyor roller 10 drivable with a controllable drive 11. Moreover, each printing module 3 comprises a number of return or guide rollers 30 and elements 31 for drying the printing ink, such as, e.g., UV lamps 31. The substrate web conveyor roller 10 serves to convey the substrate web S. The ink application means 5 of each printing module 3 comprise a drive 12 of their own with an independently controllable speed. The printing machine 1 comprises a control for controlling the rotational speed of the substrate web conveyor roller 10 and the driving speed of the drive 12 of the ink application means 5 of the or each printing module 3. It is thus possible to bring the cylindrical elements 6 of the different printing modules 3 into a desired rotative position, so that the printing image of the cylindrical element 6 is printed on the substrate web S in the right position. Moreover, the independent control of the printing module drive 12 after exchange of a cylindrical element 6 renders it possible to continue the printing process with a minimum loss of substrate web S and printing ink. In the practical example shown in FIG. 10, the substrate web conveyor rollers 10 are all driven by a single, diagrammatically shown, main driving shaft 27, which is driven by a main motor 11. The speed of the main driving shaft 27 is measured with a rotational speed indicator or encoder 28. Moreover, the tension of the substrate web S is measured with an extensometer 29 of a design known per se. Depending on the measured tension of the substrate web S, the speed of the main driving shaft 27 is controlled. Depending on the rotational speed of the main driving shaft 27, the driving motors 12 of the different printing modules 3 are then controlled. It is thus ensured that a very accurate conveyance of the substrate web and a very accurate positioning of the printing pattern on this substrate web are obtained.

It is clear that the invention is not limited to the practical example described but that various modifications are possible within the scope of the invention. Essential is that by using a non-driven impression roller with a flexible surface the exchange of the impression roller is no longer necessary, not even when changing from flexographic printing or letterpress printing to silk-screen printing, and vice versa.

What is claimed is:

1. A printing machine for printing a substrate web said printing machine comprising:

at least one printing module, said printing module being provided with an impression roller and ink application means, the ink application means comprising a cylindrical element extending parallel to the impression roller and abutting against the impression roller at a contact line with interposition of the substrate web, the cylindrical element being arranged to apply a desirable ink printing pattern to the substrate web, wherein said at least one printing module is provided with at least one circumferential bearing said at least one circumferential bearing engaging an outer surface of the cylindrical element, each of said at least one circumferential bearing in an operating condition of the printing module being in a locking position in which the cylindrical element is pressed towards and against the impression roller, said at least one circumferential bearing can be brought into an exchange condition such that the cylindrical element can be taken from the at least one printing module, the printing machine further comprising at least one additional cylindrical element intended for a different printing technique, said cylindrical element and said at least one additional cylindrical element and said at least one circumferential bearing are arranged to receive said cylindrical elements intended for said different printing techniques.

2. A printing machine according to claim 1, wherein the ink application means are bearing-mounted in the at least one printing module in such a manner as to be removable and positionable without it being necessary to remove the substrate web from the at least one printing module, the impression roller being provided with a flexible surface and being bearing-mounted for free rotation.

3. A printing machine according to claim 1 or 2, wherein the at least one circumferential bearing comprises circumferential bearing elements, which are symmetrically arranged on both sides of a plane, in which plane the contact line also extends, the forces which the circumferential bearing elements exert on the cylindrical element being symmetrical with respect to the plane.

4. A printing machine according to claim 3, wherein the forces which the circumferential bearing elements exert on the cylindrical element are directed towards the contact line where the cylindrical element and the impression roller contact each other.

5. A printing machine according to claims 1 or 2, wherein the circumferential bearing is arranged to receive cylindrical elements with different diameters.

6. A printing machine according to claims 1 or 2, wherein said at least one printing module is provided with a substrate web conveyor roller which is drivable with a controllable drive, said substrate web conveyor roller serving to convey the substrate web, the ink application means of said at least one printing module being provided with a drive with an independently controllable speed, the printing machine being provided with a control for controlling the rotational speed of the substrate web conveyor roller and the driving speed of the drive of the ink application means of said at least one printing module.

7. A printing machine according to claim 2, wherein the ink application means of said at least one printing module are of the silk-screen printing type, the cylindrical element said ink application means of the silk-screen printing type being designed as a screen which contains a squeegee, the interior of the screen being connected to an ink feed, the screen being of relatively stiff design for cooperation with the impression roller provided with a flexible surface.

8. A printing machine according to claim 2, wherein the ink application means of said at least one printing module are of the flexographic type, the cylindrical element of sais ink application means of the flexographic type being designed as a printing roller provided on the outer surface with a printing pattern, the ink application means further comprising an ink fountain, a meter roller and an anilox roller which are arranged to transfer and apply ink from the ink fountain to the outer surface of the printing roller, the printing roller being relatively hard for cooperation with the impression roller provided with a flexible surface.

9. A printing machine according to claim 2, wherein the ink application means of sais at least one printing module are of the letterpress printing type, the cylindrical element of said ink application means of the letterpress printing type being designed as a printing roller provided on the outer surface with a printing pattern, the ink application means comprising a large number of rollers, which are are arranged to transfer and apply ink from an ink fountain to the outer surface of the printing roller, the printing roller being relatively hard for cooperation with the impression roller provided with a flexible surface.

10. The printing machine according to claims 1 or 2, wherein the different printing techniques are chosen from the group consisting of silk-screen printing, flexographic printing, letterpress printing, intaglio printing and offset printing.

* * * * *